US006595852B2

(12) United States Patent
Wang

(10) Patent No.: US 6,595,852 B2
(45) Date of Patent: Jul. 22, 2003

(54) VIDEO GAMING SYSTEM AND METHOD

(76) Inventor: Chung-Hsin Wang, 1611 5th St., Unit 16, Sacramento, CA (US) 95814

( * ) Notice: Subject to any disclaimer, the term of this patent is extended or adjusted under 35 U.S.C. 154(b) by 0 days.

(21) Appl. No.: 09/886,865

(22) Filed: Jun. 20, 2001

(65) Prior Publication Data

US 2002/0198034 A1 Dec. 26, 2002

(51) Int. Cl.[7] ..... A63F 9/24
(52) U.S. Cl. ..... 463/13; 463/12
(58) Field of Search ..... 463/9–10, 12, 463/13, 16–20, 21, 22, 25; 273/274, 292, 269, 139

(56) References Cited

U.S. PATENT DOCUMENTS 5,033,744 A 7/1991 Bridgeman et al.
5,100,137 A 3/1992 Fulton
5,511,781 A 4/1996 Wood et al.
5,531,441 A * 7/1996 Dabrowski et al. ..... 463/12
5,542,669 A 8/1996 Charron et al.
6,206,780 B1 * 3/2001 Awada ..... 463/13
6,248,016 B1 * 6/2001 Walker et al. ..... 463/13
6,299,532 B1 * 10/2001 Smith ..... 463/13
6,334,613 B1 * 1/2002 Yoseloff ..... 271/292
6,358,144 B1 * 3/2002 Kadlic et al. ..... 463/13

* cited by examiner

*Primary Examiner*—Kim Nguyen

(57) ABSTRACT

In one embodiment of a video poker machine in accordance with the present invention, a processor deals ten cards face up from a virtual card deck. The player then must discard three cards using buttons associated with each card or a touch screen. The processor randomly picks and displays five of the remaining seven cards. The award is based on the resulting five-card hand. This game concept can be expanded to allow for multiple hands and stud poker. The game concept may be applied to any number of initial cards, any number of cards to be discarded, and any number of cards to be randomly selected from the remaining cards.

18 Claims, 7 Drawing Sheets

VIDEO GAMING SYSTEM AND METHOD

FIELD OF THE INVENTION

This invention relates to gaming machines and, in particular, to a video poker gaming machine.

BACKGROUND

Video poker machines used for gaming are well known in the art. Most video poker gaming machines used in casinos implement conventional rules for poker by dealing five cards face up and allowing the player to hold any number of the cards. When the player then presses a draw button, the discarded cards are replaced with new cards. A payout table cross-references the resulting hand with a win amount, and the player is paid accordingly.

What is needed is a video poker gaming machine that has more appeal than the conventional video poker gaming machines. Such a machine will be played more often to generate more revenue to the casino, resulting in increased sales of such a video poker machine.

SUMMARY

In one embodiment of a video poker machine in accordance with the present invention, a processor deals ten cards face up from a virtual card deck. The player then must discard three cards using buttons associated with each card or a touch screen. The processor randomly picks and displays five of the remaining seven cards. The award is based on the resulting five-card hand.

This game concept can be expanded to allow for multiple hands. In such a case, the player chooses to play any number of hands. The processor deals ten cards, and the player discards three of the cards. The processor then randomly picks and displays, separately for each hand played, five of the remaining cards. In this way, a good starting set of ten cards can be used to create a number of large payoff hands, making the game more exciting to the player. An award is then given based on all the hands played.

Similar concepts are presented for stud poker. The game concept may be applied to any number of initial cards, any number of cards to be discarded, and any number of cards to be randomly selected from the remaining cards.

DETAILED DESCRIPTION OF THE EMBODIMENTS

Figure 1:
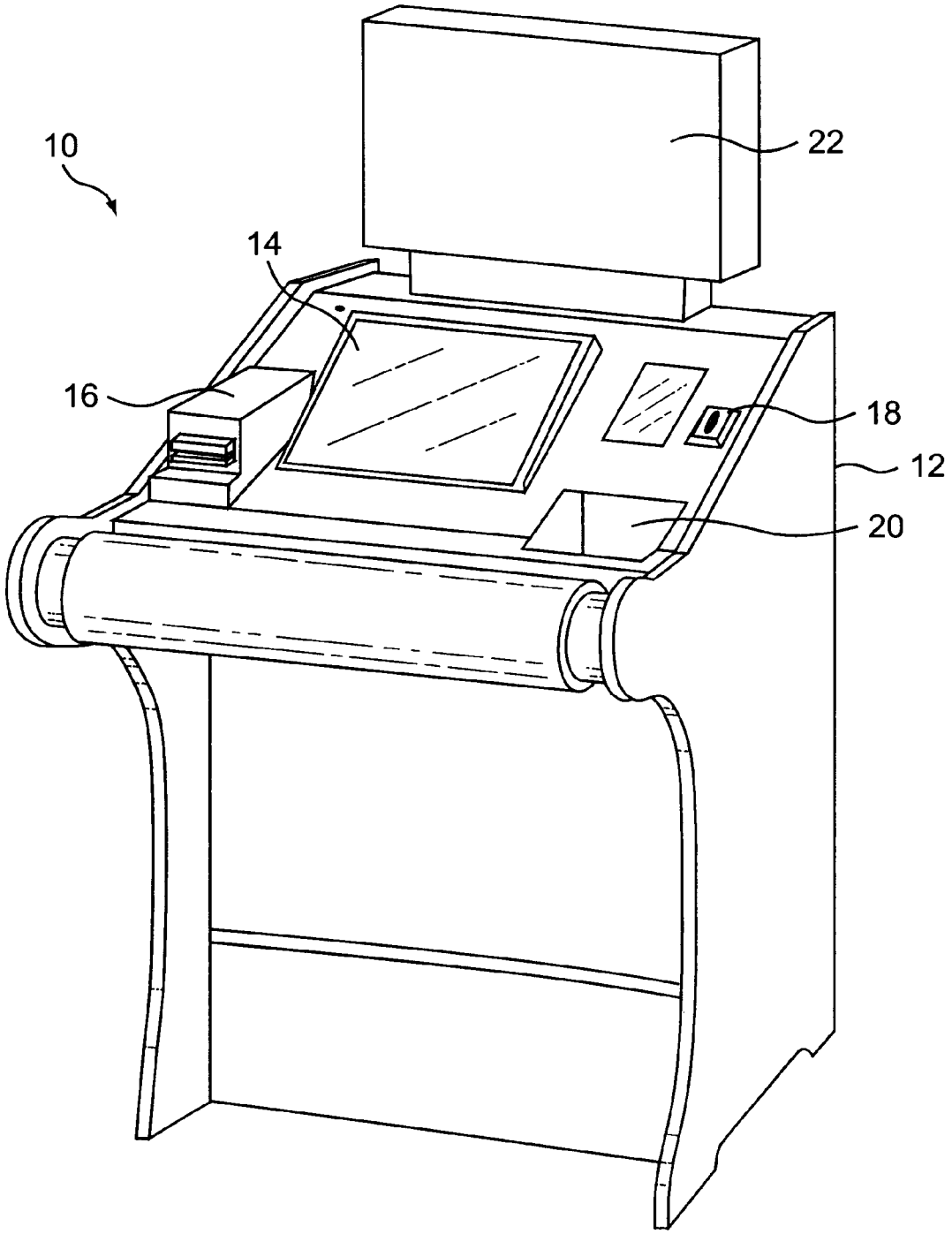
FIG. 1 illustrates an example of a video poker machine incorporating the present invention.

FIG. 1 illustrates one of the many embodiments of a video poker gaming machine that can incorporate the present invention. The particular machine shown in FIG. 1 is a slant-top video gaming machine 10 at which the user may sit and play the machine for extended periods. Gaming machine 10 consists primarily of a housing 12, a CRT screen 14 or other display device, a bill verifier 16, a coin input 18, a payout tray 20, and display glass 22 identifying the payouts for various hands and other information. A control panel may include physical buttons for making player selections, but in the present example is a touch screen that may be the main CRT screen 14 or a separate touch screen. The touch screen controls allow the player to discard particular cards, draw cards, make a wager, and deal cards.

The electronic hardware used to implement the present invention may be conventional. The difference between the present invention and conventional video poker gaming machines resides in the program memory, which is accessed by a processor and is used to run the game. Such circuitry will be described later with respect to FIG. 2.

Various patents, incorporated herein by reference, describing video poker gaming machines are cited below to illustrate the level of skill in the art and to illustrate that an adequate disclosure of a software modification to existing video poker gaming machines may consist of describing the high level operation of the machine rather than circuitry details of a conventional design. These patents include U.S. Pat. Nos. 5,542,669; 5,531,441; 5,511,781; 5,100,137; and 5,033,744. Such patents also illustrate the crowded field of video poker gaming machines.

Figure 2:
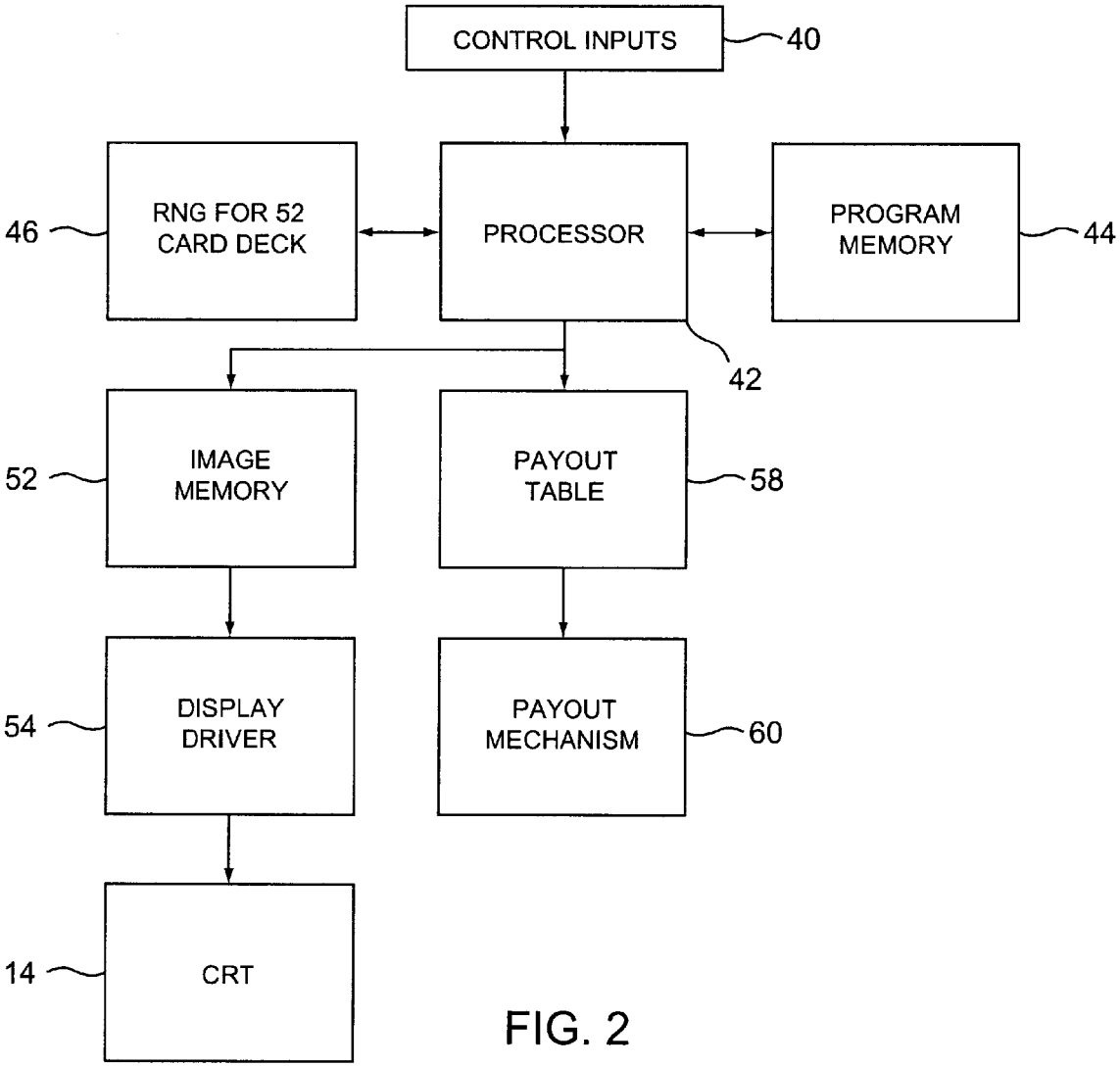
FIG. 2 illustrates the relevant functional blocks which may be used to implement the present invention.

FIG. 2 illustrates the basic functional units in one embodiment of the gaming machine. To begin a game, the player inserts into the machine coins, bills, or other means representing credits. Such means may include a card with a magnetic strip or other known means. If the machine uses a touch screen, the player then places a bet by touching virtual buttons displayed on the CRT screen 14. If there are physical buttons, the player makes selections by depressing actual buttons. The electronics associated with the touch screen or physical buttons are termed control inputs 40 in FIG. 2.

A player then, in one embodiment, presses a "deal" button on the touch screen to initiate the game. A processor 42 receives instructions from a program memory 44 for carrying out the game sequence. The hardware illustrated in FIG. 2 may be conventional, with the difference between the prior art and the present invention being the software code incorporated into program memory 44. Program memory 44 may be a ROM or other memory device external to or part of processor 42. The selection of cards from a fifty-two card deck is made using a random number generator 46 of conventional design. The random number generator 46 may be included in program memory 44. Multiple virtual decks or an infinite deck may also be used. Decks that contain jokers as wild cards may also be used.

The display of the cards on screen 14 is performed in a conventional manner. A code generated by processor 42 is converted into the relatively complex pixel pattern of a card by an image memory 52. Image memory 52 identifies the illumination levels of the various pixels on screen 14 to create the image displayed to the player. A display driver 54 converts the output of image memory 52 into electrical signals for screen 14.

After the game is over, the displayed results are compared to entries in a payout table 58, which identifies the appropriate award to be granted to the player. The award may be issued as credits or, if the player wishes to cash out, a payout mechanism 60 provides either coins or other representation of the player's award, such as by providing credits on a magnetic strip on a card.

Figure 3:
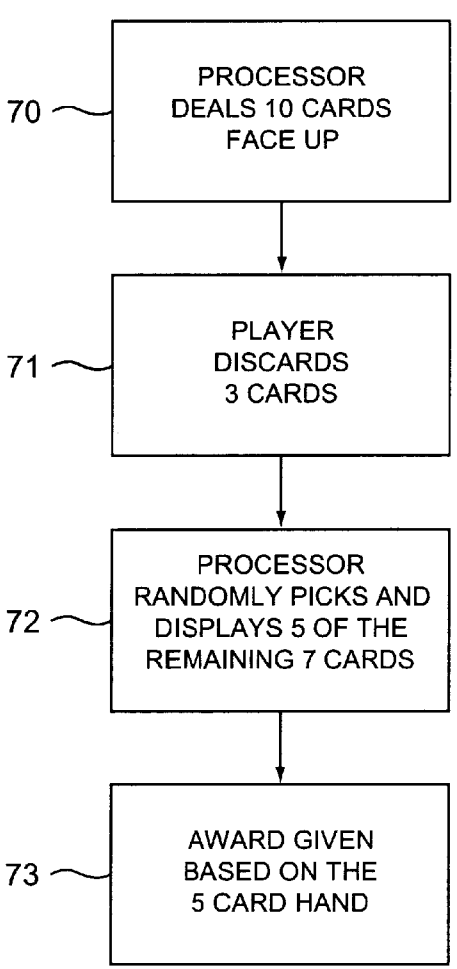
FIG. 3 is a flowchart illustrating the basic steps for a one-hand poker game in accordance with one embodiment of the present invention.
Figure 4A:
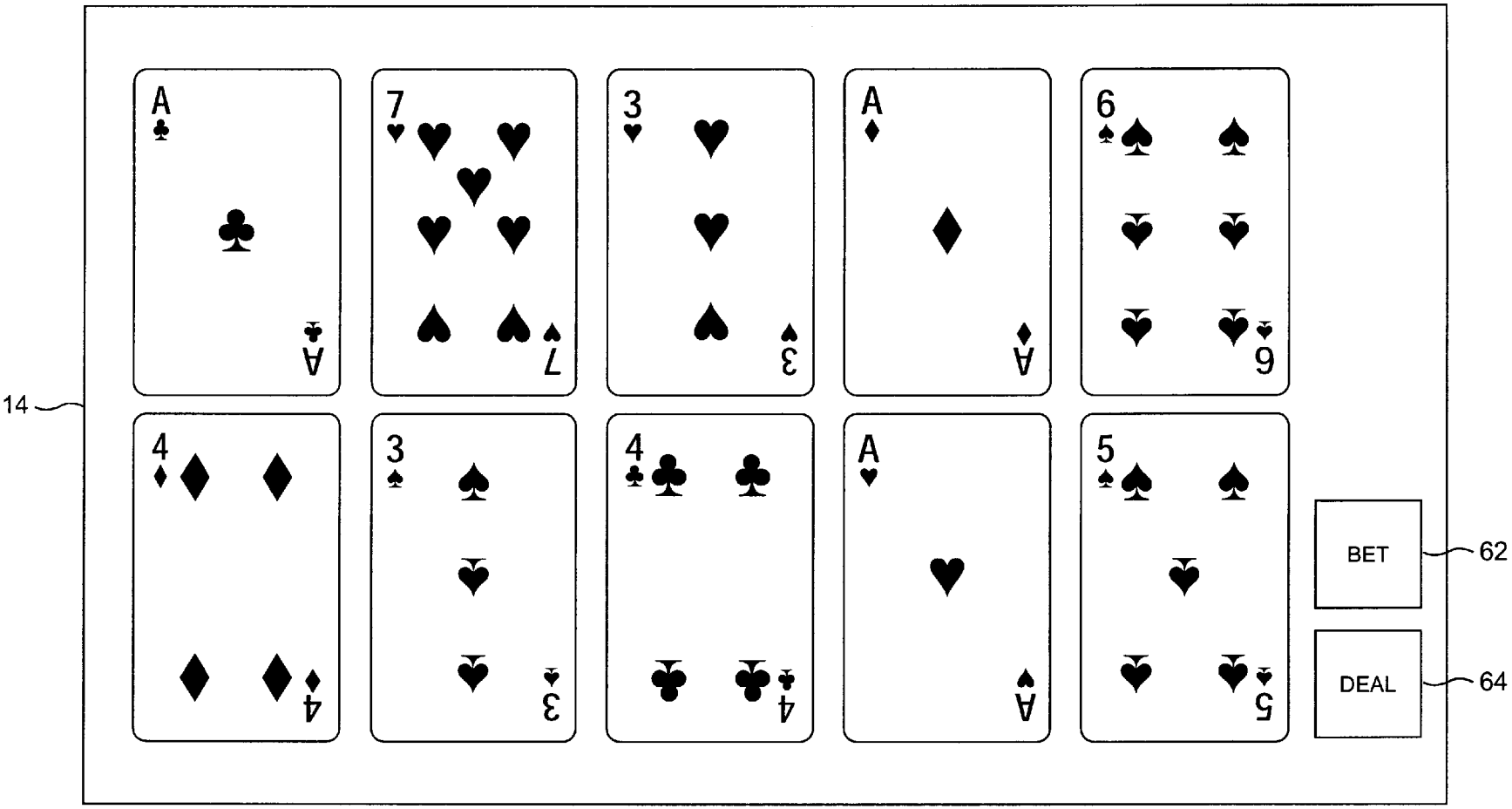
FIGS. 4A, 4B, and 4C illustrate displayed images during play of the game of FIG. 3.

FIG. 3 is a flowchart of one embodiment of the video poker game. After the player has made a wager, such as by touching the virtual bet button 62 on the touch screen 14 of FIG. 4A, the player then touches the deal button 64. In step 70 of FIG. 3, the processor deals ten cards face up from the virtual card deck, shown in FIG. 4A. In another embodiment, the processor may deal any number of cards.

Figure 4B:
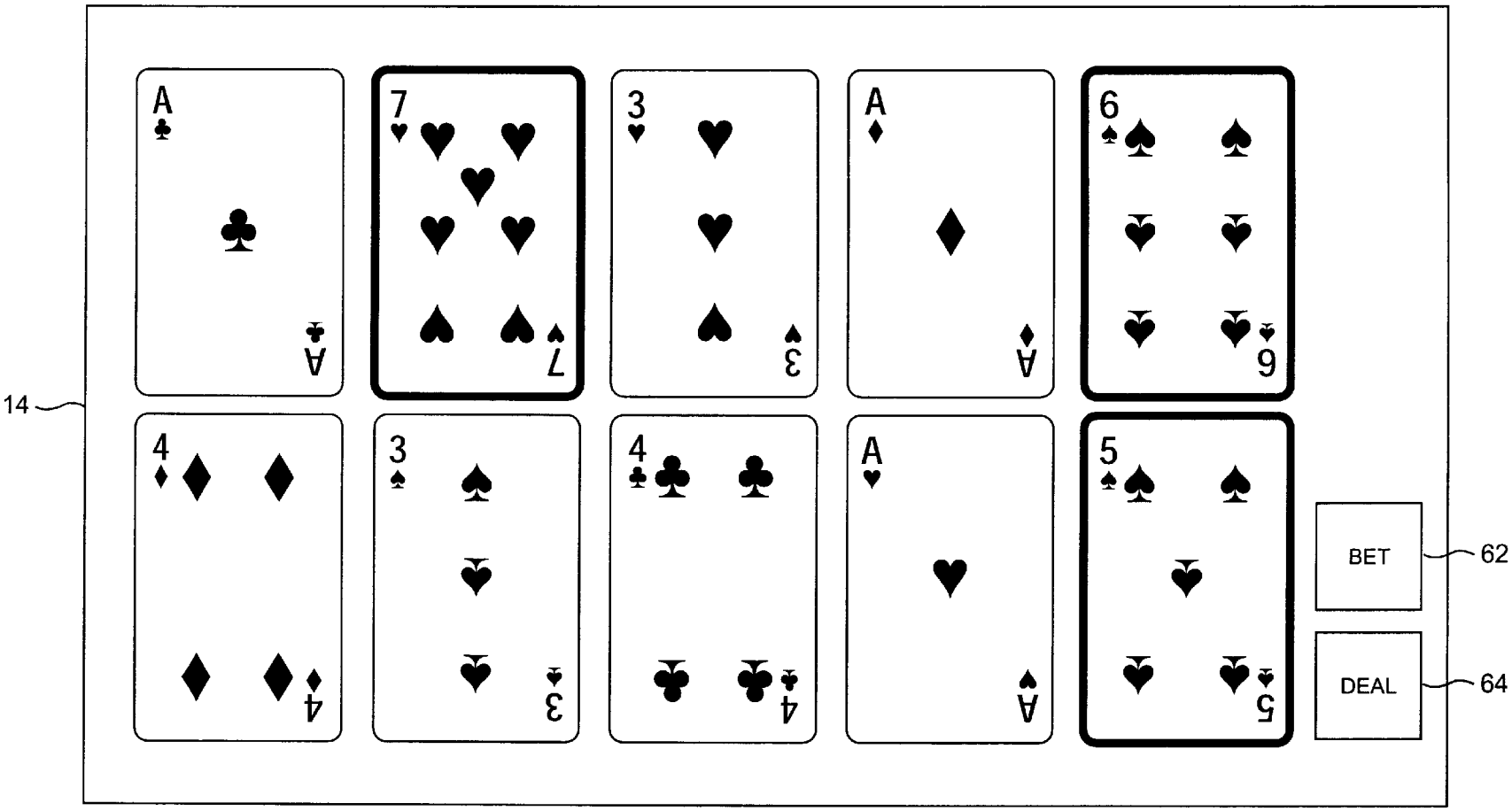

In step 71 of FIG. 3, the player is required to discard three cards from the ten cards initially dealt. This may be done by touching the cards to be discarded. The touched cards may be highlighted as shown in FIG. 4B. Alternatively, the game program may require the player to select the cards she wishes to hold. In another embodiment, any number of cards may be required to be discarded.

Figure 4C:
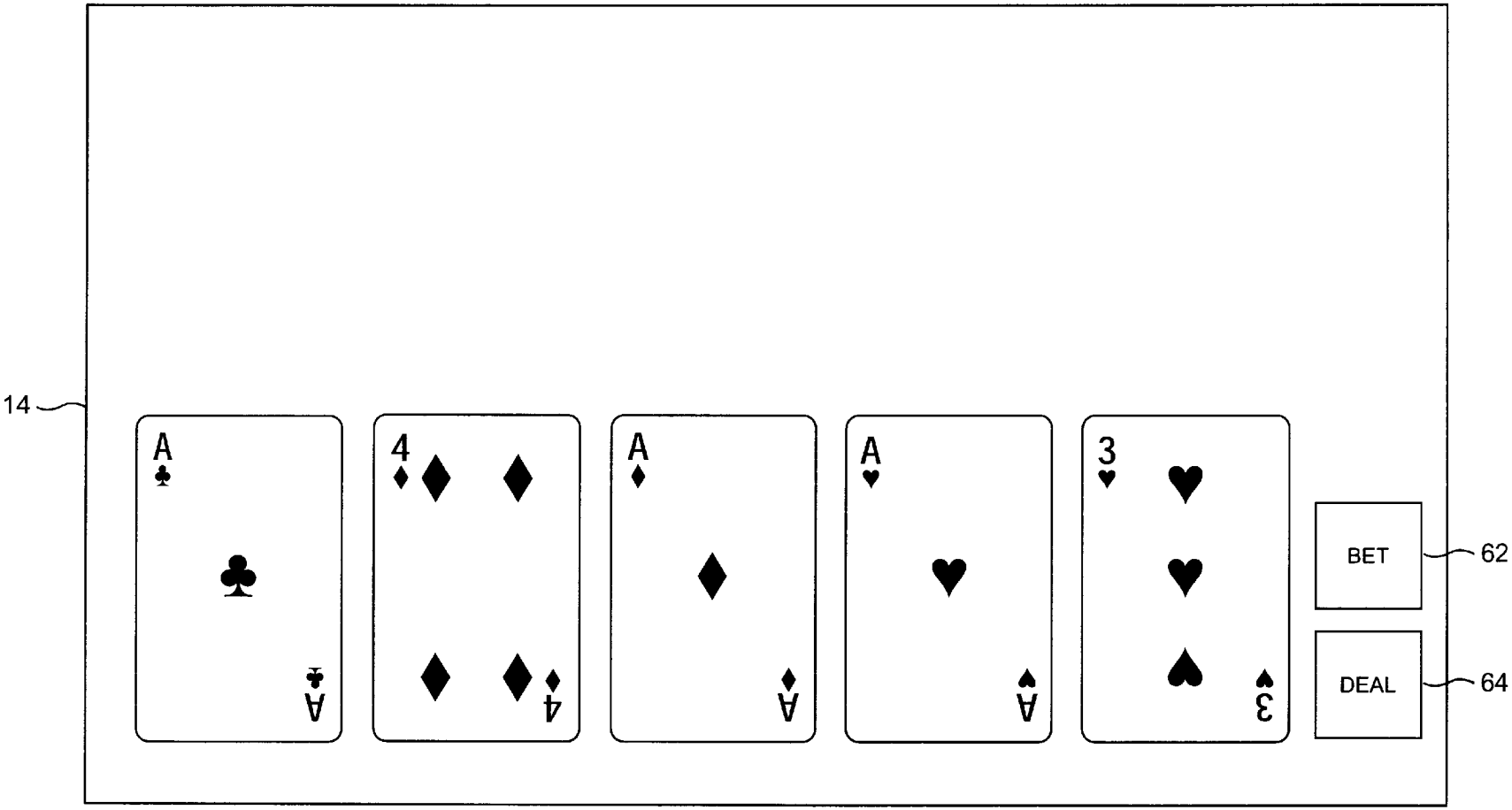

In step 72, the processor randomly picks and displays five of the remaining seven cards. This may be initiated by the player touching the deal button 64 again. The resulting hand is shown in FIG. 4C.

In step 73, an award is given based on the final five card poker hand.

The resulting game is believed to be more interesting than a conventional draw poker game since the player initially sees all the possible combinations that may result, adding more excitement to the game. Additionally, strategies are involved that are different from the strategies used in conventional video poker games, since the player is better able to estimate the chances for certain final hands In one embodiment of the machine, the player can select whether she wishes to play a conventional video poker game or the game described with respect to FIG. 3.

The basic concept of this game can be applied to many other types of related games. For example, FIG. 5 is a flowchart illustrating the game concept applied to a multi-hand format.

Figure 5:
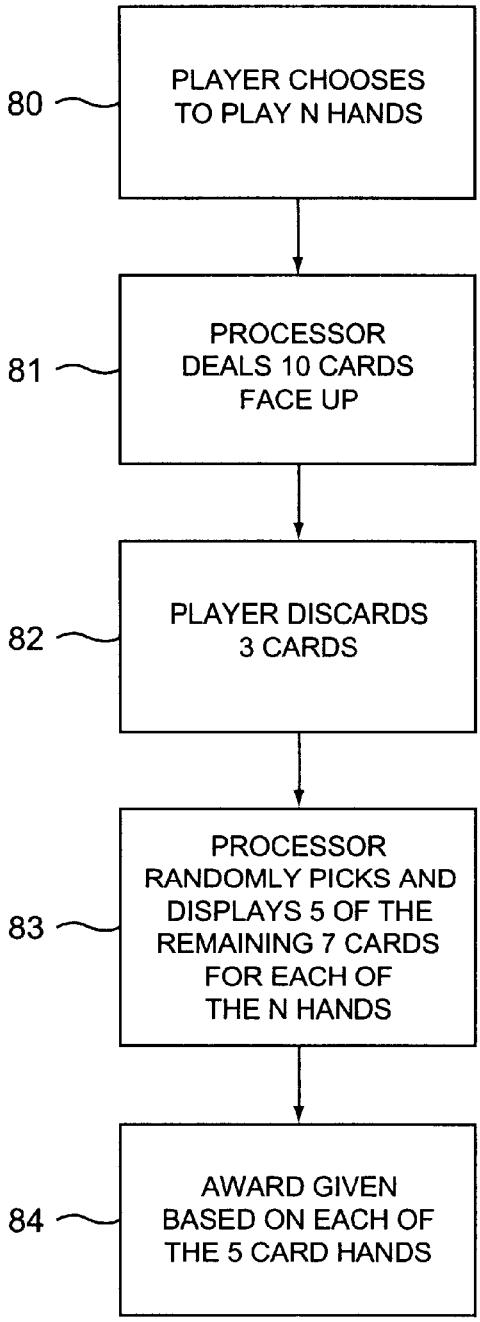
FIG. 5 is a flowchart illustrating the basic steps for a multi-hand video poker game.

In step 80 of FIG. 5, the player makes a wager for any number of hands, such as one to ten hands. The number of hands may be selected by the number of times the player touches the virtual bet button 62 in FIG. 4A. Let's assume the player selected five hands and made the appropriate wager.

In step 81, the player touches the virtual deal button 64, and the processor deals ten cards face up from the virtual card deck.

In step 82, the player is required to discard three of the cards by, for example, pressing the touch screen over the cards to be discarded.

In step 83, the player touches the virtual deal button 64, and the processor randomly picks and displays five of the remaining seven cards for each of the hands played by the player. In this particular case, since the player selected five hands, five possibly different hands will be displayed out of the seven cards. Two or more of the hands may even be identical.

In step 84, an award is given to the player based on each of the hands played.

In other embodiments, the number of cards dealt and the number of cards the player is required to discard may be different from any of the examples described herein.

Figure 6:
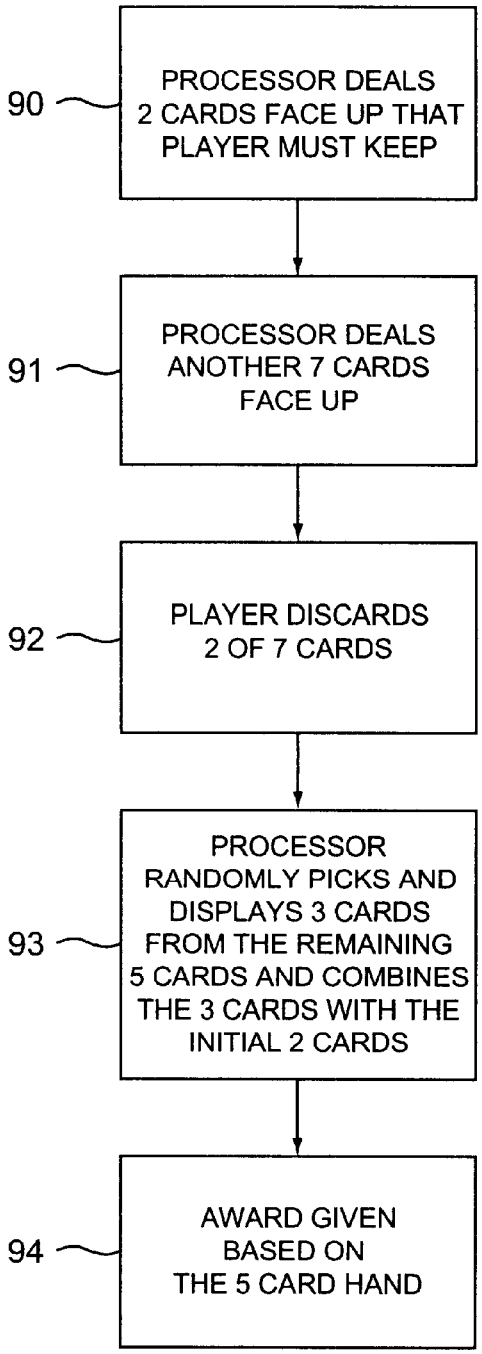
FIG. 6 is a flowchart illustrating the basic steps for a five-card stud poker game.

The inventive concept may also be applied to stud poker. FIG. 6 is a flowchart of an example of one such stud poker video game. After the player has deposited money or has bet credits, the processor deals two cards face up that the player must keep, as shown in step 90 of FIG. 6. The number of cards that the processor initially deals may be different, such as from one to four cards.

In step 91, the processor deals another seven cards face up on a different area of screen 14. The number of cards may be any number.

In step 92, the player discards two cards from the seven cards dealt in step 91.

In step 93, the processor randomly picks and displays three cards from the remaining five cards and places these three cards adjacent to the two initially dealt cards to create a five-card poker hand.

In step 94, an award is given based on the five-card poker hand.

Figure 7:
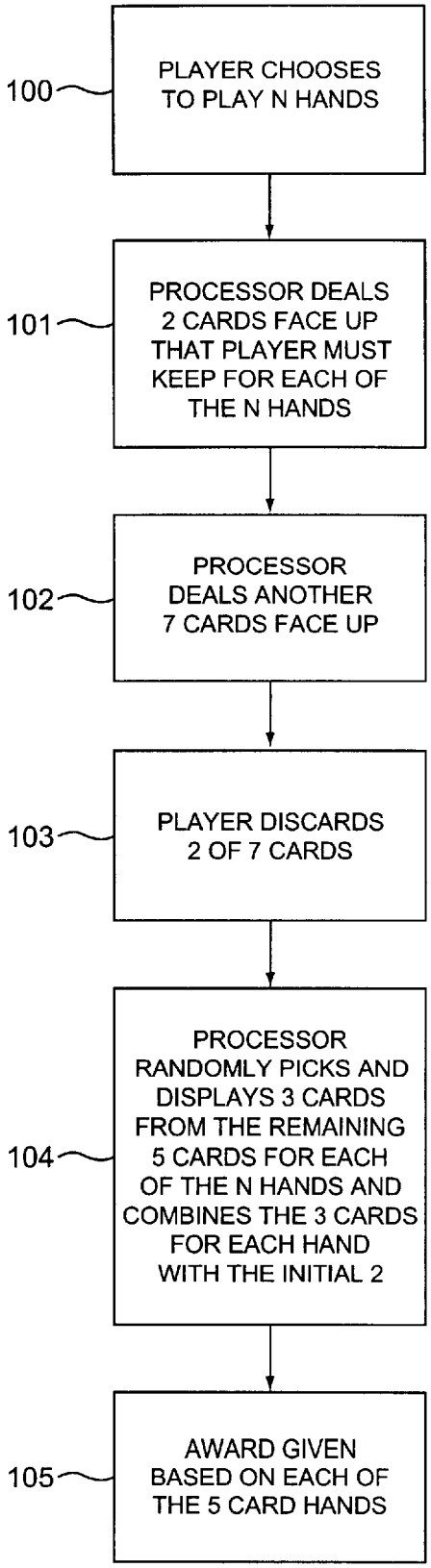
FIG. 7 is a flowchart illustrating the basic steps for a multi-hand stud poker game.

This five-card stud poker game may also be applied to a multi-hand stud poker game, as shown in FIG. 7. In step 100 of FIG. 7, the player makes a wager for any number of hands, such as five hands, by touching the bet button 62 in FIG. 4A five times.

In step 101, the processor deals two cards face up that the player must keep. These same two cards are displayed for each of the hands the player has selected. In the present example, the same two cards will be displayed in five locations on screen 14.

In step 102, the processor deals seven cards face up.

In step 103, the player discards two of the seven cards.

In step 104, the player touches the deal button 64, and the processor randomly picks and displays three cards from the remaining five cards for each hand played. Each randomly selected set of three cards is combined with the initial two cards to form five five-card poker hands. Multiple hands may be identical.

In step 105, an award is given to the player for each of the five hands played based upon the payout table.

Figure 8:
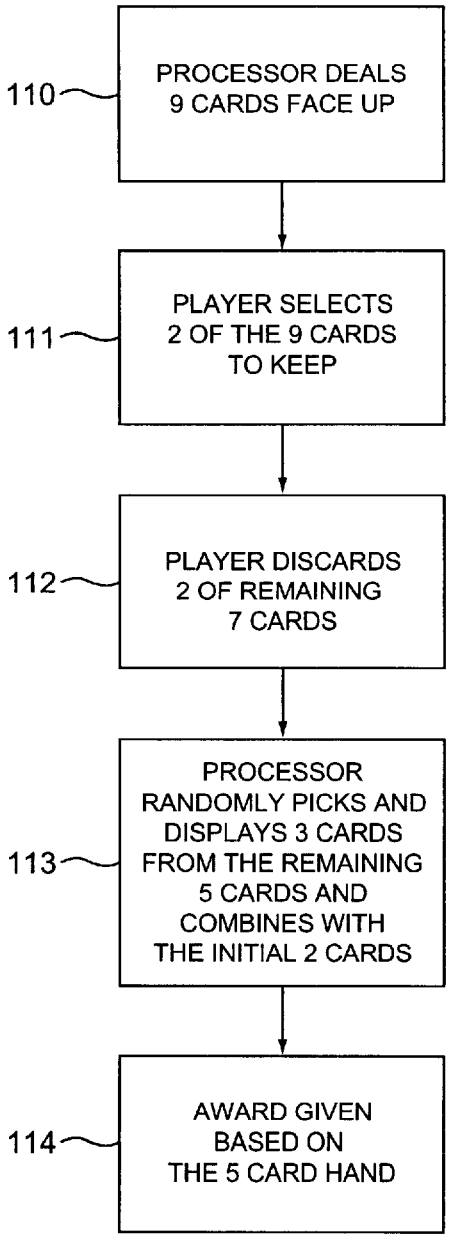
FIG. 8 is a flowchart illustrating the basic steps for a five-card stud poker game in accordance with another embodiment of the present invention.

In a variation of the stud poker game of FIG. 6, the player may initially choose two cards to keep from a set of initially dealt cards to give the player more control over the player's final hand. FIG. 8 illustrates such an embodiment.

In step 110 of FIG. 8, after the player has made a wager, the processor deals, for example, nine cards face up from the virtual deck.

In step 111, the player chooses two of the nine cards to keep. The game program may be modified to require the player to choose any number of cards such as one, two, three, or four.

In step 112, the player discards two of the remaining seven cards. The number of cards to be discarded is predetermined by the game program, but the programmer can require the player to discard one, two, three or more cards.

In step 113, the processor randomly picks and displays three cards from the remaining five cards for combining with the initial two cards selected by the player.

In step 113, an award is given based upon the resulting five cards. Accordingly, the game of FIG. 8 includes the extra step 111, where the player initially selects a predetermined number of cards to keep.

The game concept of FIG. 8 may also be applied to a multi-hand game by the player betting the number of credits required to play multiple hands. The two cards chosen in step 111 would be applied to each of the hands, and the random selection of three cards by the processor from the remaining five cards in step 113 would be performed for each of the hands. This results in two cards being common to all the hands, and three of the cards being possibly different in each hand.

In all the multi-hand games, a bonus award may be given if all hands, or other number of hands, are of the same rank such as a flush, full house, straight, three-of-a-kind, etc. To encourage full coin play, this bonus may only be available with a full coin play. Such a bonus also changes the strategy the player uses to discard cards and adds another level of excitement. The bonus amount may also be dependent on the rank of the hands.

The concepts described herein may be applied to any type of gaming machine and even to gaming over the Internet. The processing may be performed at a remote location, external to the machine.

Each of the concepts described herein may also be applied to a reel type slot machine, where the reels display symbols. One suitable processor-controlled reel type slot machine is described in U.S. Pat. No. 5,997,401, assigned to the present assignee and incorporated herein by reference. The player selects to hold the symbols displayed by certain reels after being initially spun (or "dealt"), and the slot machine randomly spins the "discarded" symbols. Buttons below each reel may be used to hold the reels. An award is given based on the final symbol combination. In this manner, all the video games described can be replicated by a processor-controlled reel type slot machine displaying cards or other symbols.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A video poker gaming system comprising:

a display device;

processing circuitry to carry out a game program, including generating an image on said display device;

said game program containing instructions for carrying out the following method performed by said video poker gaming system:

a. electronically dealing a first predetermined number of cards face up, whereby said cards are displayed to a player on said display device;

b. requiring said player to discard a second predetermined number of the dealt cards, leaving a third predetermined number of remaining cards;

c. randomly selecting a fourth predetermined number of cards from said remaining cards to form a poker hand; and d. granting an award to said player for obtaining a winning poker hand;

wherein said first, second, third, and fourth predetermined numbers are non-zero numbers.

2. The system of claim 1 wherein said first predetermined number is ten, said second predetermined number is three, said third predetermined number is seven, and said fourth predetermined number is five.

3. The system of claim 1 wherein said game program also contains instructions for:

allowing said player to play multiple hands, wherein said randomly selecting a fourth predetermined number comprises randomly selecting a fourth predetermined number of cards from said remaining cards for each of said multiple hands to form a plurality of poker hands, wherein step d comprises granting an award to said player based on each winning poker hand in said plurality of poker hands.

4. The system of claim 3 wherein said game program also contains instructions for granting a bonus award if multiple hands are of the same rank.

5. The system of claim 1 wherein said game program also contains instructions for:

electronically dealing a player a fifth predetermined number of cards face up that the player must keep, prior to electronically dealing said first predetermined number of cards, wherein said fifth predetermined number is a non-zero number;

wherein step c comprises combining said fourth predetermined number cards with said fifth predetermined number of cards to form said poker hand.

6. The system of claim 5 wherein said fifth predetermined number is two, said first predetermined number is seven, said second predetermined number is two, said third predetermined number is five, and said fourth predetermined number is three.

7. The system of claim 6 wherein said game program also contains instructions for:

allowing said player to play multiple hands, wherein said randomly selecting a fourth predetermined number comprises randomly selecting a fourth predetermined number of card from said remaining cards for each of said multiple hands to form a plurality of poker hands, wherein step d comprises granting an award to said player based on each winning poker hand in said plurality of poker hands.

8. The system of claim 7 wherein said game program also contains instructions for granting a bonus award if multiple hands are of the same rank.

9. The system of claim 1 wherein said game program also contains instructions for:

requiring said player to select a fifth predetermined number of cards to keep from said first predetermined number of cards, leaving a sixth predetermined number of cards, wherein said fifth and sixth predetermined number are non-zero numbers;

wherein step b comprises requiring said player to discard said second predetermined number of cards from said sixth predetermined number of cards.

10. A method performed by a game program for a video poker game comprising:

a. electronically dealing a first predetermined number of cards face up, whereby said cards are displayed to a player on a display device;

b. requiring said player to discard a second predetermined number of the dealt cards, leaving a third predetermined number of remaining cards;

c. randomly selecting a fourth predetermined number of cards from said remaining cards to a form poker hand; and d. granting an award to said player for obtaining a winning poker hand;

wherein said first, second, third, and fourth predetermined numbers are non-zero numbers.

11. The method of claim 10 wherein said first predetermined number is ten, said second predetermined number is three, said third predetermined number is seven, and said fourth predetermined number is five.

12. The method of claim 10 further comprising:

allowing said player to play multiple hands, wherein said randomly selecting a fourth predetermined number comprises randomly selecting a fourth predetermined number of cards from said remaining cards for each of said multiple hands to form a plurality of poker hands, wherein step d comprises granting an award to said player based on each winning poker hand in said plurality of poker hands.

13. The method of claim 12 further comprising granting a bonus award if multiple hands are of the same rank.

14. The method of claim 10 further comprising:

electronically dealing a player a fifth predetermined number of cards face up that the player must keep, prior to electronically dealing said first predetermined number of cards, wherein said fifth predetermined number of cards is a non-zero number;

wherein step c comprises combining said fourth predetermined number cards with said fifth predetermined number of cards to form said poker hand.

15. The method of claim 14 wherein said fifth predetermined number is two, said first predetermined number is seven, said second predetermined number is two, said third predetermined number is five, and said fourth predetermined number is three.

16. The method of claim 15 further comprising:

allowing said player to play multiple hands, wherein said randomly selecting a fourth predetermined number comprises randomly selecting a fourth predetermined number of card from said remaining cards for each of said multiple hands to form a plurality of poker hands, wherein step d comprises granting an award to said player based on each winning poker hand in said plurality of poker hands.

17. The method of claim 16 further comprising granting a bonus award if multiple hands are of the same rank.

18. The method of claim 10 further comprising:

requiring said player to select a fifth predetermined number of cards to keep from said first predetermined number of cards, leaving a sixth predetermined number of cards, wherein said fifth and sixth predetermined numbers of cards are non-zero numbers;

wherein step b comprises requiring said player to discard said second predetermined number of cards from said sixth predetermined number of cards.

* * * * *